US009442412B2

(12) United States Patent
Goto et al.

(10) Patent No.: US 9,442,412 B2
(45) Date of Patent: Sep. 13, 2016

(54) IMAGE FORMING APPARATUS, METHOD FOR CONTROLLING IMAGE FORMING CONDITIONS, AND NON-TRANSITORY COMPUTER-READABLE MEDIUM STORING COMPUTER-READABLE INSTRUCTIONS

(71) Applicant: Brother Kogyo Kabushiki Kaisha, Nagoya-shi, Aichi-ken (JP)

(72) Inventors: Yuji Goto, Nagoya (JP); Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/674,196

(22) Filed: Mar. 31, 2015

(65) Prior Publication Data

US 2015/0277271 A1 Oct. 1, 2015

(30) Foreign Application Priority Data

Mar. 31, 2014 (JP) ..... 2014-074838

(51) Int. Cl.
*G03G 15/043* (2006.01)
*G03G 15/00* (2006.01)

(52) U.S. Cl.
CPC ..... *G03G 15/043* (2013.01); *G03G 15/5033* (2013.01); *G03G 15/5058* (2013.01)

(58) Field of Classification Search
CPC ... B41J 29/393; G06K 15/02; G03G 15/043; G03G 15/5033; G03G 15/5058
See application file for complete search history.

(56) References Cited

U.S. PATENT DOCUMENTS

2007/0057989 A1* 3/2007 Noguchi ..... B41J 29/393 347/19

FOREIGN PATENT DOCUMENTS

JP 2004098593 A 4/2004

* cited by examiner

*Primary Examiner* — Sarah Al Hashimi
(74) *Attorney, Agent, or Firm* — Banner & Witcoff, Ltd.

(57) ABSTRACT

An image forming apparatus includes a forming unit and a controller. The forming unit includes a developing unit and a multi-beam scanning unit. The multi-beam scanning unit includes an N number of light sources for the developing unit. The controller causes the multi-beam scanning unit to form marks on a surface of at least one photosensitive body. The controller adjusts an interval between an electrostatic latent image and another electrostatic latent image based on a level of a signal outputted from the sensor according to the endmost scan lines of each of the marks.

10 Claims, 11 Drawing Sheets

IMAGE FORMING APPARATUS, METHOD FOR CONTROLLING IMAGE FORMING CONDITIONS, AND NON-TRANSITORY COMPUTER-READABLE MEDIUM STORING COMPUTER-READABLE INSTRUCTIONS

CROSS-REFERENCE TO RELATED APPLICATION

This application claims priority from Japanese Patent Application No. 2014-074838, filed on Mar. 31, 2014, which is incorporated herein by reference in its entirety.

TECHNICAL FIELD

Aspects described herein relate to an image forming apparatus configured to form electrostatic latent images on a surface of a photosensitive body.

BACKGROUND

A known image forming apparatus includes a multi-beam scanning unit. The multi-beam scanning unit includes a plurality of light sources for a single developing unit and is configured to form electrostatic latent images on a surface of a photosensitive body by a plurality of light beams emitted from the respective different light sources. In such an image forming apparatus, for example, one or more of an optical error, a mechanical error, and displacement of optics due to temperature increase may cause a change in an interval between electrostatic latent images formed on the surface of the developing unit by respective light beams emitted from the respective different light sources. As a result, the quality of an image to be formed may be deteriorated.

Such a known image forming apparatus has a function of adjusting an interval between electrostatic latent images to be formed by respective light beams emitted from the respective different light sources. More specifically, the image forming apparatus causes the multi-beam scanning unit to form solid marks using the plurality of light sources. Each solid mark is formed by a single one of the light sources and has a plurality of scan lines with no gap therebetween. The known image forming apparatus further includes sensors that output signals corresponding to respective positions of the marks formed on the surface of the photosensitive body. The image forming apparatus adjusts the interval between electrostatic latent images to be formed by respective light beams emitted from the respective different light sources based on the signals outputted from the sensors.

SUMMARY

According to aspects of the present disclosure, an image forming apparatus is provided that includes at least one photosensitive body, a drive unit configured to drive the at least one photosensitive body to rotate, a forming unit including, a developing unit, and a multi-beam scanning unit including N number (greater than 1) of light sources for the developing unit, a sensor, and a controller. The controller is configured to cause the multi-beam scanning unit to form marks on a surface of the at least one photosensitive body being rotated by the drive unit. Each of the marks has a plurality of scan lines that are formed by light emitted from at least one of the N number of light sources and are spaced apart from each other. Additionally, at least endmost scan lines of the plurality of scan lines in a sub-scanning direction in each of the marks are formed by light emitted from the same one of the N number of light sources. The controller may further adjust an interval between an electrostatic latent image to be formed on the surface of the at least one photosensitive body by any one of the N number of light sources and another electrostatic latent image to be formed on the surface of the at least one photosensitive body by another of the N number of light sources based on a level of a signal from the sensor for the endmost scan lines of each of the marks. According to further aspects, methods and computer readable media storing instructions may be provided for processes similar to those described above.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
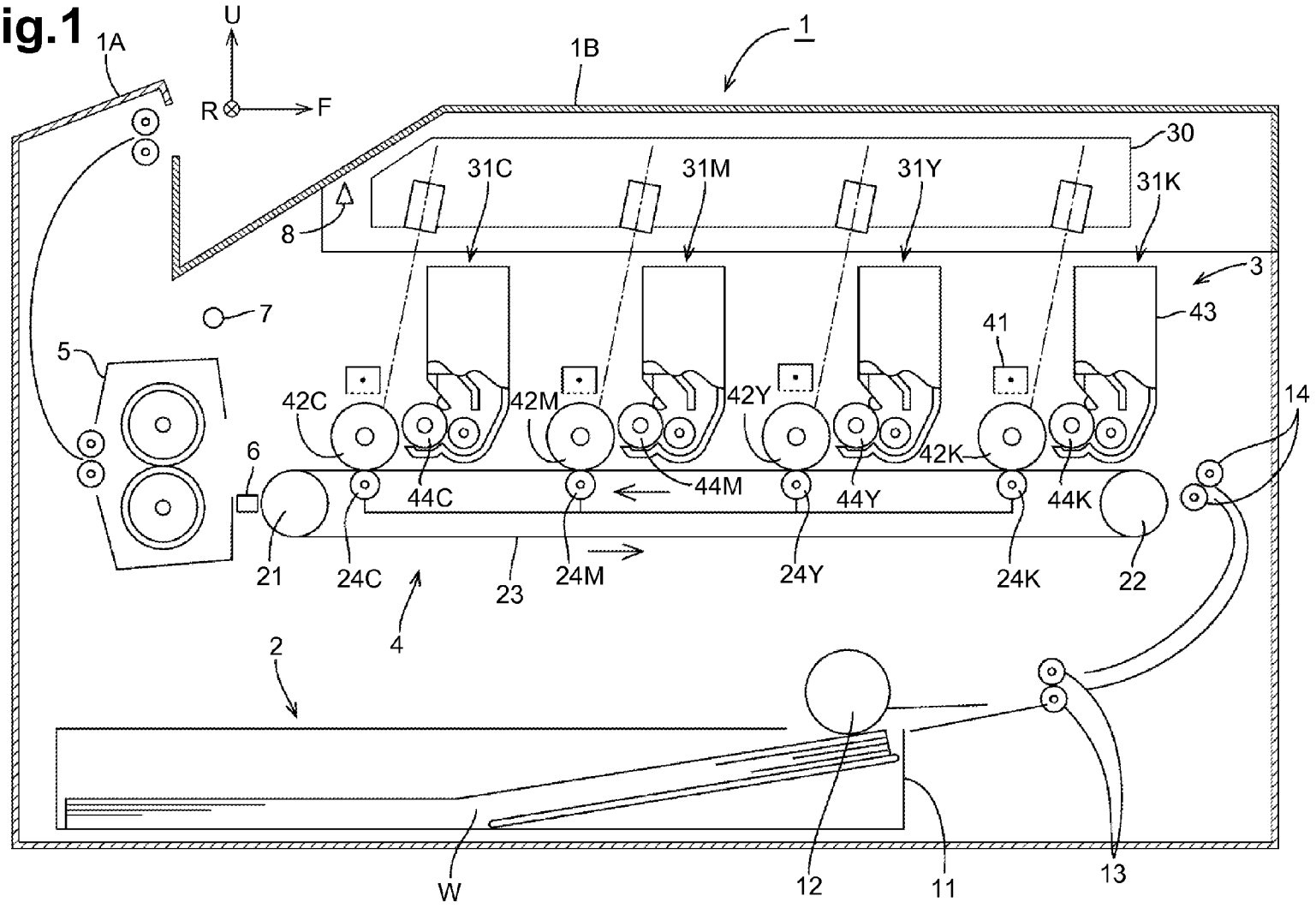
FIG. 1 is a sectional schematic view depicting a mechanical configuration of a printer in an illustrative embodiment according to one or more aspects of the disclosure.

Illustrative embodiments will be described with reference to the accompanying drawings. A printer 1 according to an illustrative embodiment will be described with reference to FIGS. 1 to 9. In the description below, the right side of the drawing sheet of FIG. 1 is defined as the front ("F") of the printer 1, the far side of the drawing sheet of FIG. 1 is defined as the right ("R") of the printer 1, and the upper side of the drawing sheet of FIG. 1 is defined as the top ("U") of the printer 1. As depicted in FIG. 1, the printer 1 may be a color laser printer of a tandem direct transfer type. The printer 1 is capable of forming a color image using toner of a plurality of colors, for example, black (K), yellow (Y), magenta (M), and cyan (C). The printer 1 is an example of an image forming apparatus. In the following description, suffixes K (black), Y (yellow), M (magenta), and C (cyan), which represent the respective colors, are appended to the reference numerals of the components when distinguishing the components of the printer 1 by a respective color or distinguishing certain descriptive terms by the respective color. In FIG. 1, the identical components are not distinguished by color.

The printer 1 includes a casing 1A. The printer 1 further includes a supply unit 2, an image forming unit 3, a conveying mechanism 4, a fixing unit 5, a mark sensor 6, a temperature sensor 7, and a cover sensor 8 within the casing 1A. The printer 1 further includes a cover 1B at the top of the casing 1A. The cover 1B is configured to be opened and closed with respect to the casing 1A.

The supply unit 2 is disposed in a bottom portion of the printer 1. The supply unit 2 includes a tray 11, a pickup roller 12, a conveyor roller pair 13, and a registration roller pair 14. The tray 11 is configured to support one or more sheets W. The pickup roller 12 picks up, one by one, one or more sheets W accommodated in the tray 11. The conveyor roller pair 13 and the registration roller pair 14 convey the picked sheet W to the conveying mechanism 4.

The conveying mechanism 4 includes an endless belt 23, a drive roller 21, and a driven roller 22. The belt 23 is looped around the drive roller 21 and the driven roller 22. The belt 23 is an example of an image carrier. As the drive roller 21 rotates, the belt 23 rotates such that a surface of the belt 32 facing photosensitive drums 42 moves rearward. Consequently, the belt 23 conveys the sheet W, which has been placed onto the belt 23 by the registration roller pair 14, from the image forming unit 3 to the fixing unit 5. A plurality, for example, four, of transfer rollers 24K, 24Y, 24M, and 24C are disposed inside of the loop of the belt 23 and arranged in this order in a conveying direction of a sheet W, e.g., in a front-rear direction.

The image forming unit 3 is an example of a forming unit. The image forming unit 3 includes an exposure unit 30 and a plurality, for example, four, of process units 31K, 31Y, 31M, and 31C.

The exposure unit 30 is an example of a multi-beam scanning unit. The exposure unit 30 includes, a plurality, for example, two, of light sources for each color. The exposure unit 30 is capable of forming two scan lines on a surface of each photosensitive drum 42 for each color simultaneously using two light beams irradiated from the respective different light sources. The exposure unit 30 includes a first light source 32, a second light source 33, a polygon mirror 34, a polygon motor 35, lenses 36, and a reflection mirror 37. A set of the first light source 32 and the second light source 33 is provided for each developing roller 44 provided for each color (e.g., four sets of the first light source 32 and the second light source 33 are provided). The first light source 32 and the second light source 33 may be, for example, laser diodes. The first light source 32 and the second light source 33 may be both mounted on a single package or may be mounted on respective different packages.

Figure 2:
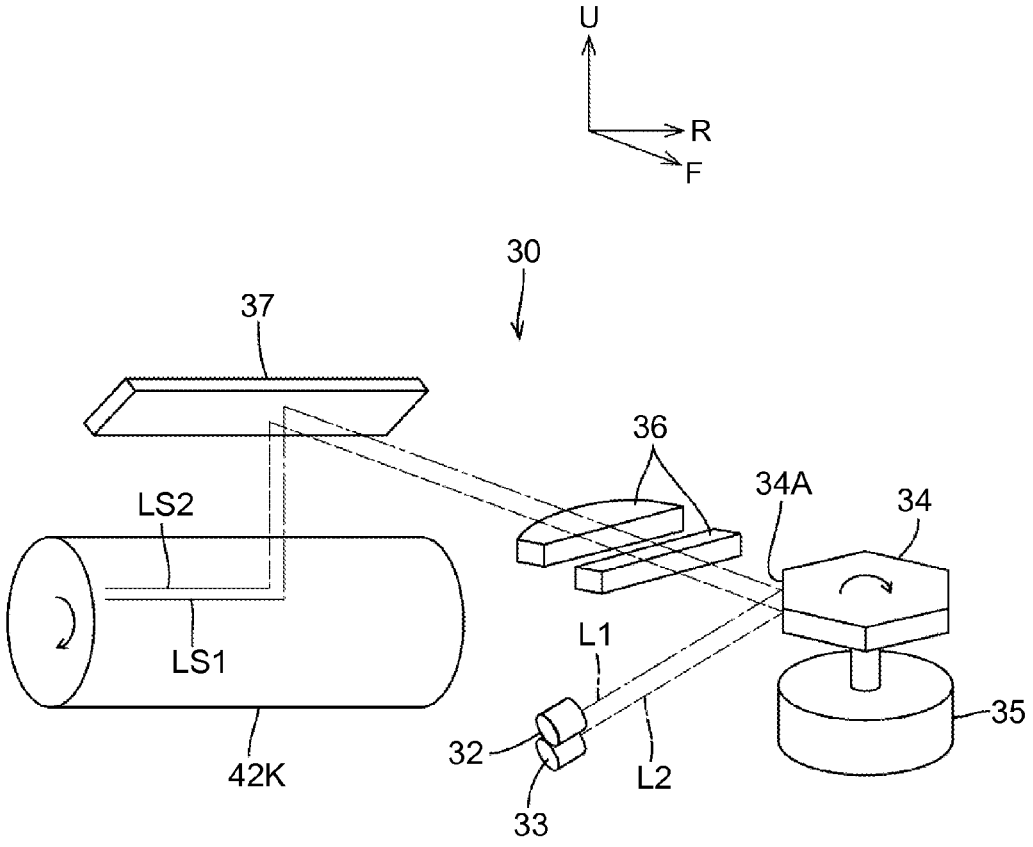
FIG. 2 is a schematic view depicting a configuration of an exposure unit in the illustrative embodiment according to one or more aspects of the disclosure.

FIG. 2 illustrates a configuration for exposing the surface of the black photosensitive drum 42K with light beams. The polygon mirror 34 is an example of a rotating polygon mirror. The polygon mirror 34 has a plurality of reflecting surfaces 34A and rotates based on a driving force by the polygon motor 35. The polygon mirror 34 deflects a light beam L1 emitted from the first light source 32 and a light beam L2 emitted from the second light source 33 using one of the reflecting surfaces 34A thereof while rotating. The deflected light beams L1 and L2 are irradiated onto the surface of the photosensitive drum 42K via the lenses 36 and the reflection mirror 37.

The first light source 32 and the second light source 33 are disposed so as to irradiate the surface of the photosensitive drum 42K with a light beam L1 and a light beam L2, respectively, while a predetermined interval is provided between the light beam L1 and the light beam L2 in a sub-scanning direction, e.g., in a rotating direction of the photosensitive drum 42K. The exposure unit 30 forms scan lines on the surface of the photosensitive drum 42K to form an electrostatic latent image on the surface of the photosensitive drum 42K by emitting at least one of a light beam L1 and a light beam L2 from at least one of the first light source 32 and the second light source 33 based on image data corresponding to a print instruction. In FIG. 2, reference character "LS1" indicates a first scan line formed by a light beam L1 and reference character "LS2" indicates a second scan line formed by a light beam L2.

In the illustrative embodiment, the process units 31K, 31Y, 31M, and 31C are arranged in this order in the conveying direction, e.g., in the front-rear direction. Additionally, while the process units 31K, 31Y, 31M, and 31C store toner of respective colors, the process units 31K, 31Y, 31M, and 31C have the same configuration. Therefore, a description will be made for the black process unit 31K only.

The process unit 31K includes a transfer roller 24K, a charger 41, the photosensitive drum 42K, a toner box 43, and a developing roller 44K. The photosensitive drum 42K is an example of a photosensitive body and is another example of the image carrier. The developing roller 44K is an example of a developing unit. The black toner box 43 and the black developing roller 44K are an example of an achromatic developing unit. The magenta-, yellow-, and cyan-toner boxes 43 and the magenta-, yellow-, and cyan-developing rollers 44M, 44Y, 44C, and 44K are an example of a chromatic developing unit.

The charger 41 charges the surface of the photosensitive drum 42K uniformly. The developing roller 44K develops an electrostatic latent image formed on the surface of the photosensitive drum 42K by the exposure unit 30 to form a black toner image on the surface of the photosensitive drum 42K by supplying toner onto the surface of the photosensitive drum 42K from the toner box 43. The transfer roller 24K is disposed facing the photosensitive drum 42K across the belt 23. The transfer roller 24K transfers the toner image formed on the surface of the photosensitive drum 42K onto a sheet W.

Then, the conveying mechanism 4 further conveys the sheet W having one or more toner images of respective colors transferred thereon to the fixing unit 5. Then, the fixing unit 5 fixes the one or more toner images onto the sheet W by heat. Thereafter, the sheet W is discharged onto the top of the printer 1.

Figure 3:
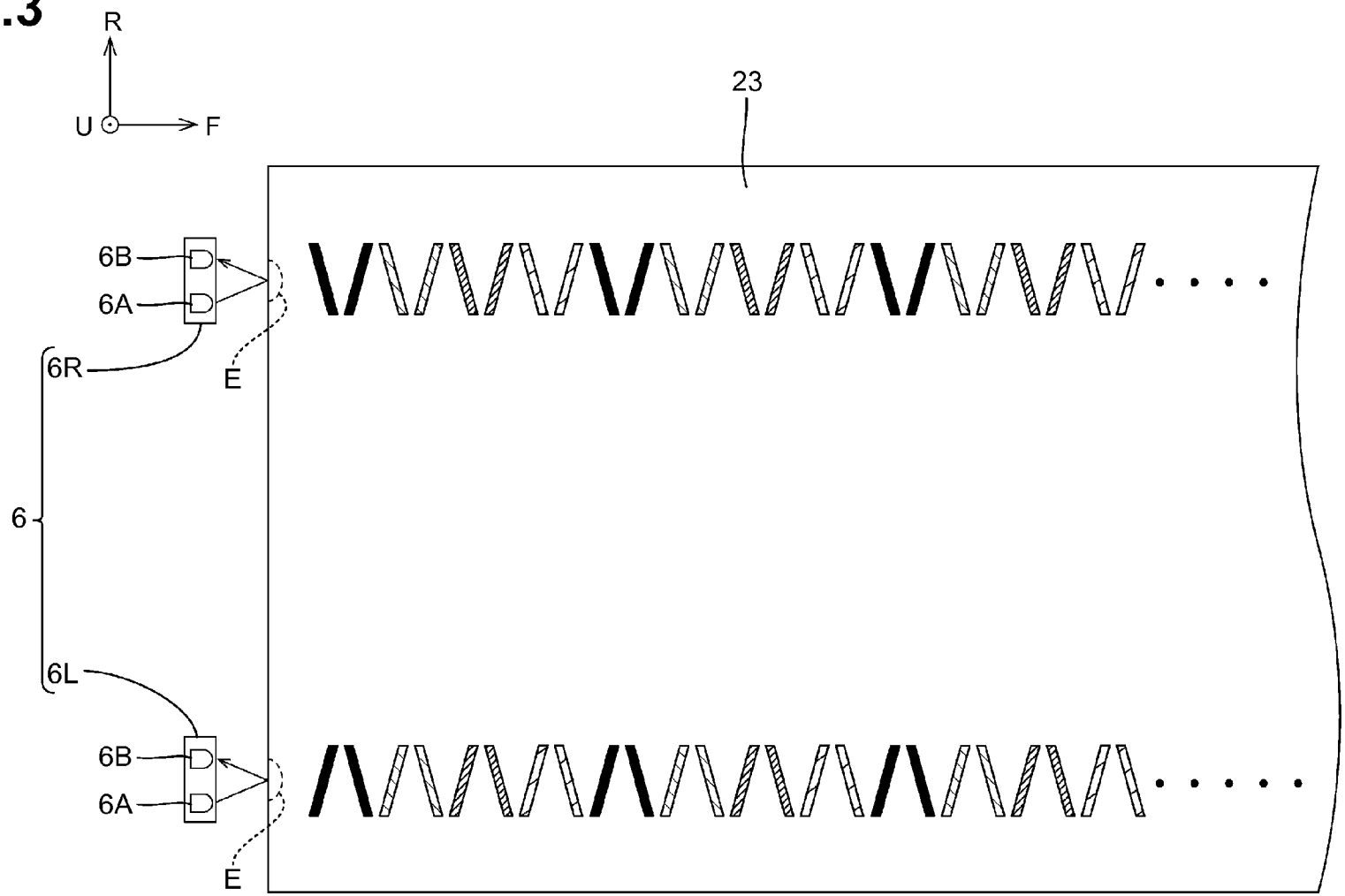
FIG. 3 illustrates an arrangement of mark sensors and example marks in the illustrative embodiment according to one or more aspects of the disclosure.

The mark sensor 6 is an example of a sensor. The mark sensor 6 outputs detection signals according to the presence or absence of a mark on the belt 23. More specifically, as depicted in FIG. 3, the mark sensor 6 includes a sensor 6R and a sensor 6L. The sensor 6R is disposed facing a right portion of the belt 23 in a right-left direction and the sensor 6L is disposed facing a left portion of the belt 23 in the right-left direction.

The sensors 6R and 6L may be reflective-type optical sensors that each includes a light-emitting element 6A, e.g., a light-emitting diode, and a the light-receiving element 6B, e.g., a phototransistor. The mark sensor 6 is configured such that, in each of the sensors 6R and 6L, the light-emitting element 6A irradiates a corresponding detection area E on the belt 23 with light and the light-receiving element 6B receives the light reflected from the corresponding detection area E. An amount of reflected light received in each light-receiving element 6B changes depending on whether a mark is present or absent within the corresponding detection area E. Marks which have been formed by the respective process units 31K, 31Y, 31M, and 31C and have been transferred onto the belt 23 are consecutively detected by one of the sensors 6R and 6L. The mark sensor 6 outputs detection signals having different levels according to the amount of reflected light received in the light-receiving element 6B. In the illustrative embodiment, the larger amount of reflected light received in the light-receiving elements 6B, the mark sensor 6 outputs a detection signal having a higher level. The belt 23 has a higher reflectivity than toner of each color. Therefore, the amount of reflected light received in the mark sensor 6 when no mark is present within the corresponding detection area E is larger than the amount of reflected light received in the mark sensor 6 when a mark is present within the corresponding detection area E.

The temperature sensor 7 outputs detection signals according to the internal temperature of the casing 1A. The cover sensor 8 outputs detection signals according to whether the cover 1B is opened or closed.

Figure 4:
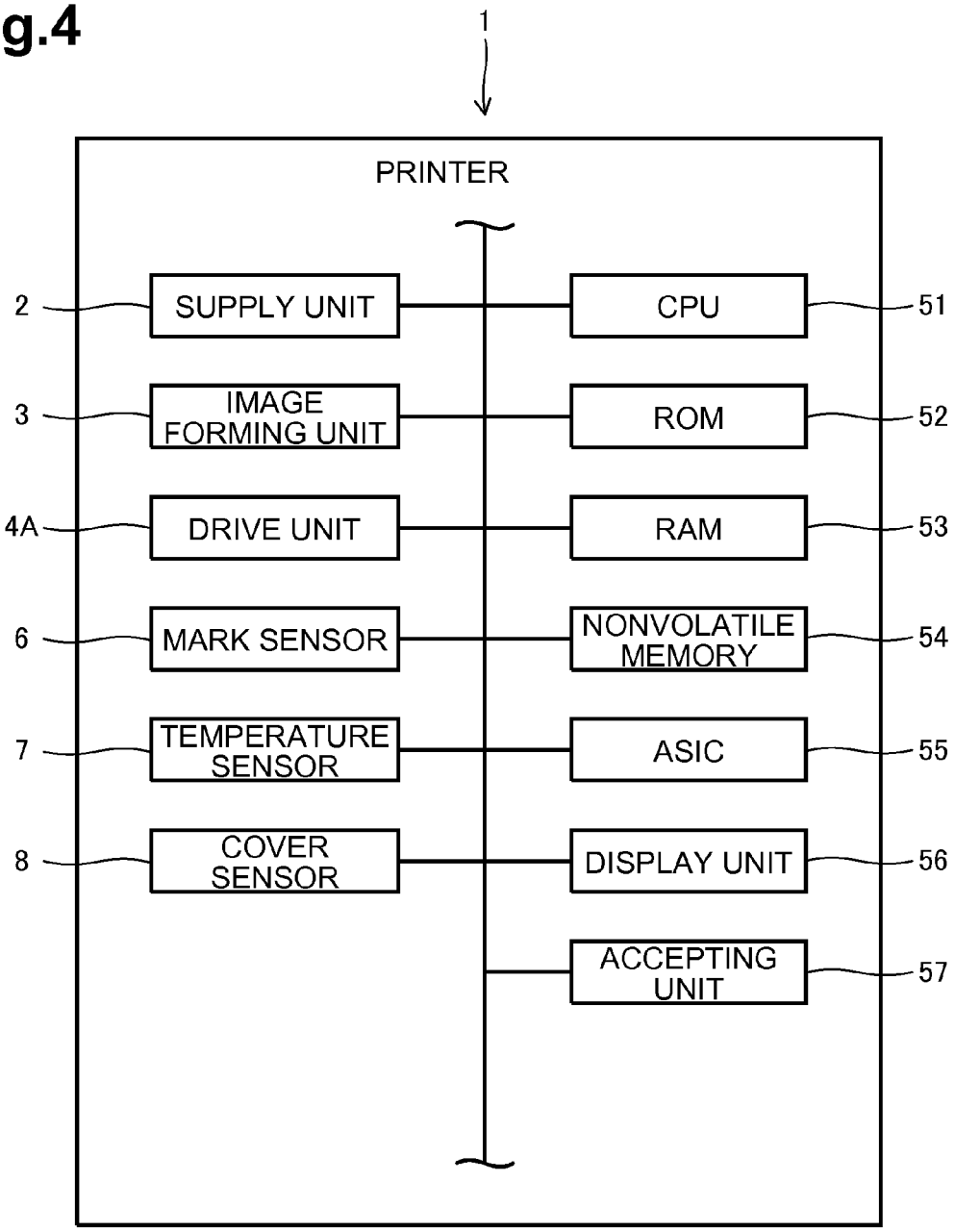
FIG. 4 is a block diagram depicting an electrical configuration of the printer in the illustrative embodiment according to one or more aspects of the disclosure.

As depicted in FIG. 4, the printer 1 further includes a drive unit 4A, a central processing unit ("CPU") 51, a read-only memory ("ROM") 52, a random-access memory ("RAM") 53, a nonvolatile memory 54, an application-specific integrated circuit ("ASIC") 55, a display unit 56, and an accepting unit 57 as well as the supply unit 2.

The drive unit 4A drives the photosensitive drums 42 and the conveying mechanism 4 to rotate. The drive unit 4A is capable of changing one or both of a rotating speed of the photosensitive drums 42 and a conveying speed of the conveying mechanism 4 by the control of the CPU 51.

The ROM 52 stores various programs (e.g., computer-readable instructions), which include, for example, programs for executing control processing (e.g., instructing the CPU 31 to perform or control certain processing) and programs for controlling operations of units or components of the printer 1. The RAM 53 is used as a workspace for temporarily storing the control programs read from ROM 52 during execution of various programs by the CPU 51 or as a storage area for temporarily storing data. The nonvolatile memory 54 may be a rewritable memory such as a nonvolatile RAM, a flash memory, a hard disk, or an electrically erasable programmable ROM.

The CPU 51 is an example of a controller. The CPU 51 controls operations of the units or components of the printer 1 in accordance with the programs read from the ROM 52. The ASIC 55 may be, for example, a hardware circuit dedicated to image processing. The display unit 56 includes a liquid crystal display and a lamp and displays various setting screens and operating statuses of the printer 1. The accepting unit 57 includes an operating unit and a communication unit. The operating unit includes a plurality buttons and allows a user to input various instructions therethrough. The communication unit allows the printer 1 to perform wired or wireless communication with an external device (not depicted).

Figure 5:
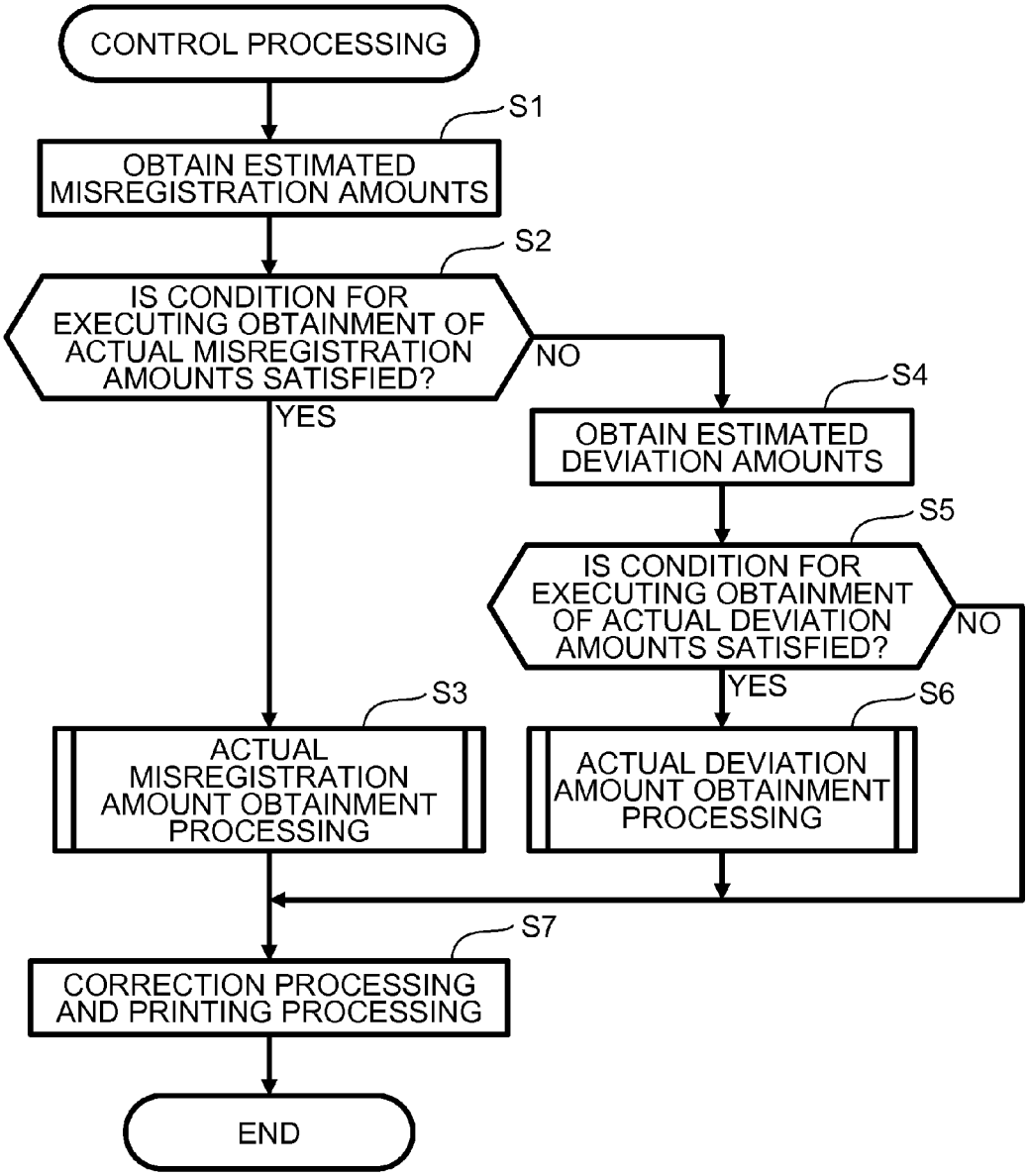
FIG. 5 is a flowchart depicting control processing in the illustrative embodiment according to one or more aspects of the disclosure.
Figure 8:
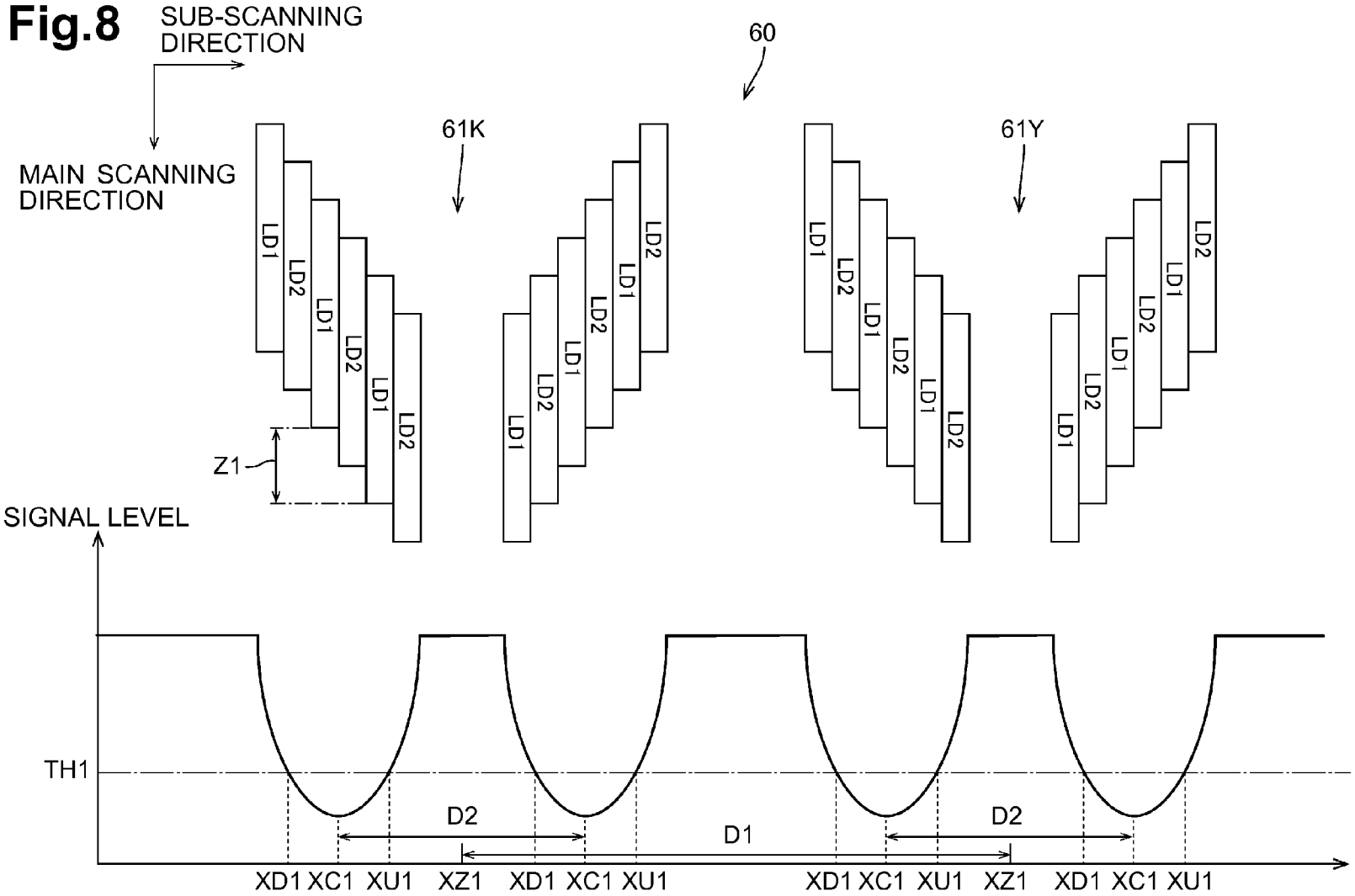
FIG. 8 is a diagram depicting a relationship between a mark pattern for obtaining actual misregistration amounts and a change in a detection signal level in the illustrative embodiment according to one or more aspects of the disclosure.
Figure 9:
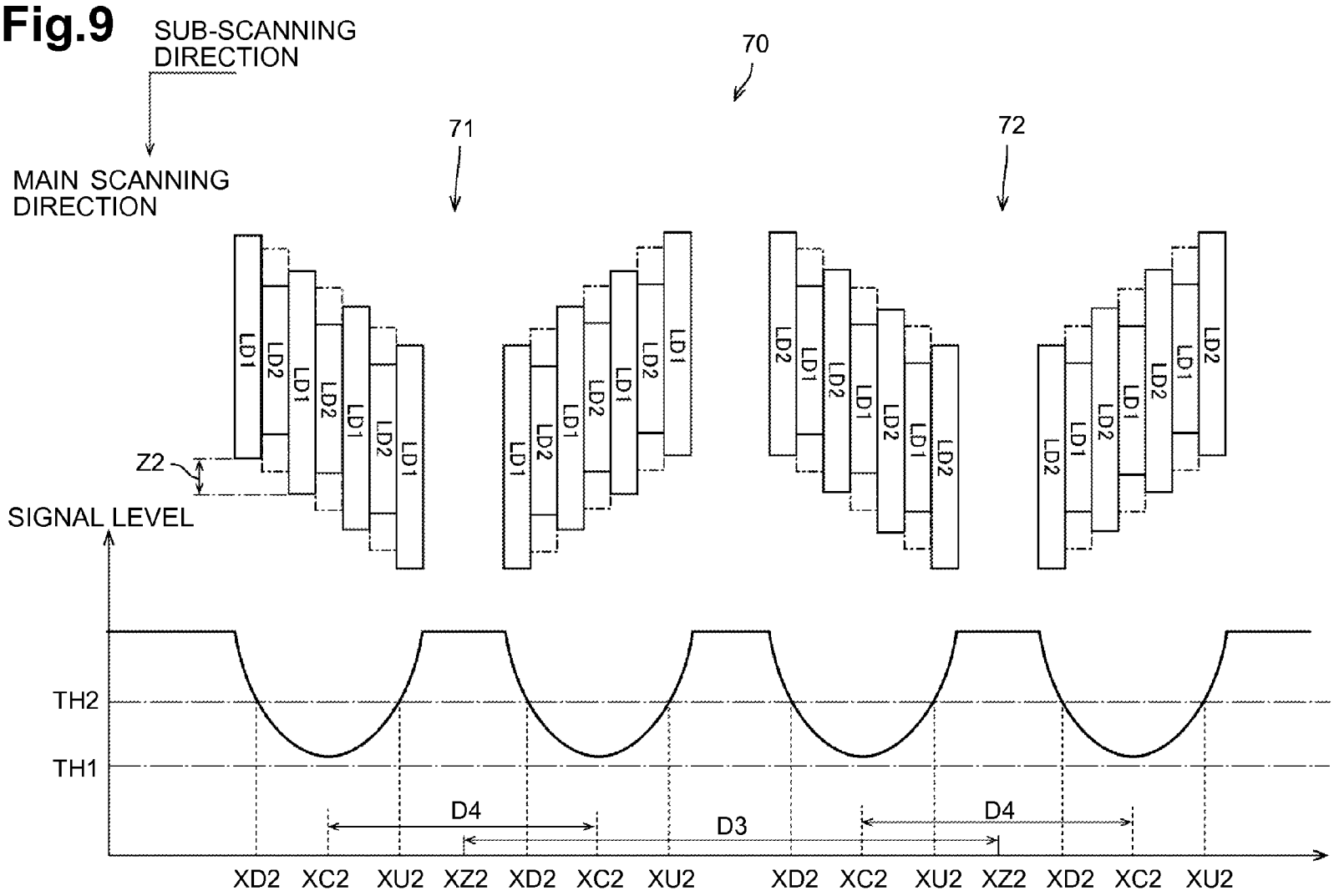
FIG. 9 is a diagram depicting a relationship between a mark pattern for obtaining actual deviation amounts and a change in a detection signal level in the illustrative embodiment according to one or more aspects of the disclosure.

Referring to FIGS. 5 and 9, the control executed by the CPU 51 will be described in detail. FIG. 8 illustrates a mark pattern 60 for obtaining actual misregistration amounts, including marks 61, and FIG. 9 illustrates a mark pattern 70 for obtaining actual relative positional deviation amounts (hereinafter, referred to as "actual deviation amounts"), including a first mark 71 and a second mark 72. In FIGS. 8 and 9, reference character "LD1" indicates a first toner line obtained by development of a first scan line LS1 and reference character "LD2" indicates a second toner line obtained by development of a second scan line LS2. As the power of the printer 1 is turned on, the CPU 51 determines whether, for example, the accepting unit 57 has received a print instruction. When the CPU 51 determines that the accepting unit 57 has received a print instruction, the CPU 51 executes the control processing of FIG. 5. The print instruction may be an instruction to cause the printer 1 to perform a printing operation for forming an image onto a sheet W.

As depicted in FIG. 5, based on an amount of change in one or more factors that may cause color misregistration, the CPU 51 estimates an amount of color misregistration for each color that might have occurred since the last time the last color misregistration correction processing was executed (e.g., obtains an estimated misregistration amount for each color) (e.g., step S1). The color misregistration includes improper alignment of positions where toner images are transferred onto a sheet W among the process units 31 for respective colors, and more specifically, a relative displacement of positions of toner images in adjustment colors relative to a position of a toner image in a reference color. The color misregistration correction processing corrects the transfer positions where toner images in adjustment colors are to be transferred onto a sheet W so as to reduce the degree of color misregistration. Hereinafter, and by way of example, the reference color includes black and the adjustment color includes yellow, magenta, and/or cyan. The color misregistration includes a relative displacement in a main-scanning direction and a relative displacement in the sub-scanning direction.

In step S1, the CPU 51 obtains the amount of change in each of one or more factors that may cause color misregistration since the last color misregistration correction processing was executed. Then, the CPU 51 further obtains an estimated amount of color misregistration that may be caused by each of the one or more factors by converting the obtained amount of change based on a conversion table that shows misregistration amounts relative to unit change amounts predetermined by experiment. In other embodiments, for example, the CPU 51 may obtain an estimated misregistration amount for each color through calculation using a computing equation based on the amount of change in each of the one or more factors that may cause color misregistration, without using such a conversion table above. In a case where a plurality of factors are taken into consideration, for each color, the CPU 51 may obtain an estimated misregistration amount on a factor-by-factor basis and determine a total sum of all of the estimated misregistration amounts as an estimated misregistration amount. Alternatively or additionally, the CPU 51 may determine an average of all of the estimated misregistration amounts as an estimated misregistration amount. In still other examples, the CPU 51 may multiply each estimated misregistration amount by an appropriate weighting factor and determine a total sum of the estimated misregistration amounts obtained through multiplication as an estimated misregistration amount.

The one or more factors that may cause color misregistration include various factors, for example, the number of openings and closings of the cover 1B and the change in temperature and/or humidity in the casing 1A. In the illustrative embodiment, the number of openings and closings of the cover 1B and the change in internal temperature of the casing 1A may be taken into consideration as the factors that may cause color misregistration. The CPU 51 obtains an amount of change in temperature since the last color misregistration correction processing was executed, based on detection signals outputted from the temperature sensor 7, and further obtains the number of openings and closings the cover 1B since the last color misregistration correction processing was executed, based on detection signals outputted from the cover sensor 8.

Upon obtainment of the estimated misregistration amounts, the CPU 51 determines whether a condition for executing obtainment of actual misregistration amounts is satisfied (e.g., step S2). In one example, when at least one of the estimated misregistration amounts is greater than or equal to a first reference amount, the CPU 51 determines that the condition for executing obtainment of actual misregistration amounts is satisfied (e.g., YES in step S2). When the CPU 51 determines that the condition for executing obtainment of actual misregistration amounts is satisfied in step S2, the CPU 51 executes actual misregistration amount obtainment processing of FIG. 6 (e.g., step S3).

Figure 6:
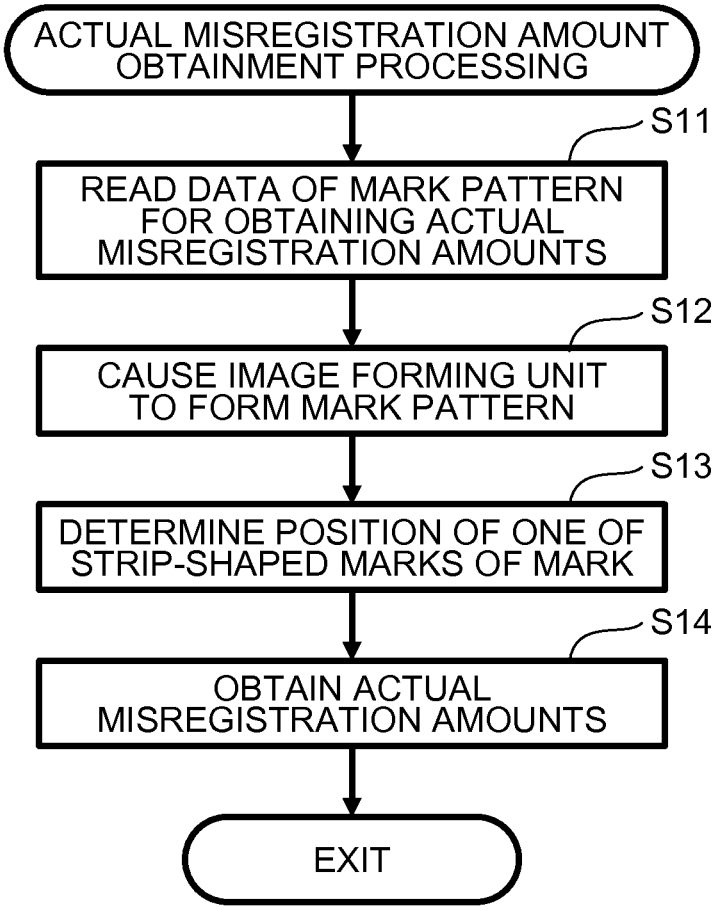
FIG. 6 is a flowchart depicting actual misregistration amount obtainment processing in the illustrative embodiment according to one or more aspects of the disclosure.

As depicted in FIG. 6, the CPU 51 reads data of the mark pattern 60 from the nonvolatile memory 54 (e.g., step S11). Then, the CPU 51 causes the drive unit 4A to drive (e.g., rotate) the conveying mechanism 4 and the photosensitive drums 42 and causes the image forming unit 3 to form the mark pattern 60 onto the belt 23 (e.g., step S12).

In one example, as depicted in FIG. 3, the image forming unit 3 forms the mark pattern 60 onto each end portion of the belt 23 in the right-left direction, e.g., onto each particular portion of the end portions in the right-left direction that pass the respective detection areas E where the sensors 6R and 6L irradiate with light, respectively. In the illustrative embodiment, the detection areas E each have a width of a plurality of toner lines. The mark pattern 60 includes a plurality of marks 61, for example, a black mark 61K, a yellow mark 61Y, a magenta mark 61M, and a cyan mark 61C, which are aligned in this order in the sub-scanning direction. Each mark 61 includes a pair of strip-shaped marks, e.g., a first strip-shaped mark and a second strip-shaped mark. The first and second strip-shaped marks extend in one direction and at least one of the first and second strip-shaped marks is angled by a predetermined amount with respect to the main-scanning direction. In the illustrative embodiment, as depicted in FIG. 3, both of the first and second strip-shaped marks of each mark 61 are angled by the same degree/angle with respect to the main-scanning direction.

The CPU 51 causes the exposure unit 30 to form electrostatic latent images for marks 61 of the mark pattern 60 for obtaining actual misregistration amounts, on the surface of each of the rotating photosensitive drums 42K, 42Y, 42M, and 42C. The exposure unit 30 emits a light beam L1 and a light beam L2 from the first light source 32 and the second light source 33, respectively, to repeatedly form two scan lines LS1 and LS2 on the surface of each of the photosensitive drums 42K, 42Y, 42M, and 42C. More specifically, as depicted in FIG. 2, the exposure unit 30 forms two scan lines LS1 and LS2 on the surface of each of the photosensitive drums 42K, 42Y, 42M, and 42C simultaneously by reflecting the light beams L1 and L2 emitted from the first light source 32 and the second light source 33, respectively, off the same one of the reflecting surfaces 34A of the polygon mirror 34 at the same time. This configuration may enable an increase in an exposing speed as compared with a case where an exposure unit exposes a surface of each photosensitive drum by a light beam emitted from a single light source.

In step S12, the exposure unit 30 forms a set of two scan lines, e.g., a first scan line LS1 and a second scan line LS2, at a single scanning of the polygon mirror 34 similar to the scanning performed at the time of printing onto a sheet W. Thus, endmost toner lines of each mark 61 in the sub-scanning direction are formed by the respective different light sources. That is, in each mark 61, one of the endmost toner lines in the sub-scanning direction may be a first toner line LD1 obtained by development of a first scan line LS1 formed by a laser beam L1 emitted from the first light source 32 and the other of the endmost toner lines in the sub-scanning direction may be a second toner line LD2 obtained by development of a second scan line LS2 formed by a laser beam L2 emitted from the second light source 33. The mark 61 is an example of a mark for obtaining a color misregistration amount and is an example of a mark for obtaining a position of the mark.

Upon starting formation of the mark pattern 60 on each of the right and left end portions of the belt 23, the CPU 51 obtains an actual misregistration amount of each of marks 61 in the respective colors based on the level of a detection signal that is outputted, from the mark sensor 6, corresponding to both endmost toner lines of each of the marks 61 in the sub-scanning direction (e.g., steps S13 and S14). For example, as depicted in FIG. 8, the level of the detection signal outputted from the mark sensor 6 falls below a first threshold TH1 after one of endmost toner lines of one of first and second strip-shaped marks of a mark 61 in the sub-scanning direction passes a corresponding detection area E. Additionally, the level of the detection signal outputted from the mark sensor 6 rises above the first threshold TH1 while the other of the endmost toner lines of the one of the first and second strip-shaped marks of the mark 61 in the sub-scanning direction passes the corresponding detection area E. The CPU 51 determines a position XC1 as a position of the one of the first and second strip-shaped marks of the mark 61. The position XC1 may be a middle position between a position XD1 and a position XU1 (e.g., step S13). The position XD1 corresponds to a timing at which the level of the detection signal outputted from the mark sensor 6 reaches the first threshold TH1 while decreasing. The position XU1 corresponds to a timing at which the level of the detection signal outputted from the mark sensor 6 reaches the first threshold TH1 while increasing.

The CPU 51 determines a position XZ1 as a position of a mark 61 in the sub-scanning direction. This determination is made for each mark 61 in one of the four colors. The position XZ1 may be a middle position between the position XC1 of one of the first and second strip-shaped marks of a mark 61 and the position XC1 of the other of the first and second strip-shaped marks of the mark 61. The CPU 51 further obtains an interval D1 between a reference color mark 61K and each adjustment color mark 61Y, 61M, and 61C in the sub-scanning direction. The interval D1 between a reference color mark and an adjustment color mark varies depending on an actual misregistration amount of the adjustment color mark in the sub-scanning direction with respect to the reference color mark. The CPU 51 obtains an actual misregistration amount of an adjustment color mark in the sub-scanning direction with respect to the reference color mark on a color basis (e.g., step S14), and stores the obtained actual misregistration amounts in the nonvolatile memory 54.

The CPU 51 obtains an interval D2 between the position XC1 of the first strip-shaped mark and the position XC1 of the second strip-shaped mark in each mark 61, and then obtains a difference in interval D2 between the reference color mark 61K and each adjustment color mark 61Y, 61M, and 61C. The amount of the difference in interval D2 between the reference color mark 61K and each adjustment color mark 61Y, 61M, and 61C varies in accordance with an actual misregistration amount of an adjustment color mark in the main-scanning direction relative to the position of the reference color mark. Therefore, the CPU 51 obtains an actual misregistration amount of adjustment color mark in the main-scanning direction on a color basis (e.g., step S14), and stores the obtained actual misregistration amounts in the nonvolatile memory 54.

Upon obtaining the actual misregistration amounts, the routine proceeds to step S7 of FIG. 5. In step S7, the CPU 51 causes the image forming unit 3 to perform printing a sheet W based on image data in response to the print instruction while adjusting the transfer positions for images in respective adjustment colors so as to compensate for the actual misregistration amounts. After the printing operation is completed, the CPU 51 ends the control processing.

In step S2, when the CPU 51 determines the condition for executing obtainment of actual misregistration amounts is not satisfied (e.g., NO in step S2), the CPU 51 estimates, for each color, an amount of relative positional deviation between electrostatic latent images due to errors between the paired light sources (hereinafter, referred to as "relative positional deviation") that might have occurred since the last time relative positional deviation correction processing was executed, based on the amount of change in one or more factors that may cause the relative positional deviation (e.g., obtains an estimated deviation amount for each color) (e.g., step S4). The relative positional deviation includes a relative positional deviation between an electrostatic latent image formed on the surface of one of the photosensitive drums 42 by a light beam L1 emitted from the first light source 32 and an electrostatic latent image formed on the surface of the same one of the photosensitive drums 42 by a light beam L2 emitted from the second light source 33, i.e., a relative positional deviation between electrostatic latent images formed by respective different light sources. The relative positional deviation may occur in each of the paired light sources 32 and 33 provided for each color. The relative positional deviation includes a relative positional deviation in the main-scanning direction and a relative positional deviation in the sub-scanning direction.

According to some arrangements, the CPU 51 obtains the amount of change in one or more factors that may cause a relative positional deviation since the last relative positional deviation correction processing was executed. Then, the CPU 51 further obtains an estimated amount of relative positional deviation that may be caused by each of the one or more factors by converting the obtained amount of change based on a conversion table that shows positional deviation amounts relative to unit change amounts predetermined by experiment. In other embodiments, for example, the CPU 51 may obtain an estimated deviation amount through calculation using a computing equation based on the amount of change in each of the one or more factors that may cause relative positional deviation, without using such a conversion table above. In a case where a plurality of factors are taken into consideration, for each color, the CPU 51 may obtain an estimated deviation amount on a factor basis and determines a total sum of all of the estimated deviation amounts as an estimated deviation amount. Alternatively or additionally, the CPU 51 may determine an average of all of the estimated deviation amounts as an estimated deviation amount to be obtained. In still other examples, the CPU 51 may multiply each estimated deviation amount by an appropriate weighting factor and determine a total sum of the estimated deviation amounts obtained through multiplication as an estimated deviation amount.

The one or more factors that may cause a relative positional deviation include various factors, for example, an optical error, a mechanical error, displacement of optics due to temperature increase, and fluctuations in wavelength of light beams. In the illustrative embodiment, the change in internal temperature of the casing 1A may be taken into consideration as the factor that may cause a relative positional deviation. The above-described factors are examples of factors that causes a relative positional deviation between electrostatic latent images formed by respective different light sources.

Subsequent to obtaining the estimated deviation amounts, the CPU 51 determines whether a condition for executing obtainment of actual deviation amounts is satisfied (e.g., step S5). In one or more examples, when at least one of the estimated deviation amounts is greater than or equal to a second reference amount, the CPU 51 determines that the condition for executing obtainment of actual deviation amounts is satisfied (e.g., YES in step S5). When the CPU 51 determines that the condition for executing obtainment of actual deviation amounts is satisfied in step S5, the CPU 51 executes actual deviation amount obtainment processing of FIG. 7 (e.g., step S6).

Figure 7:
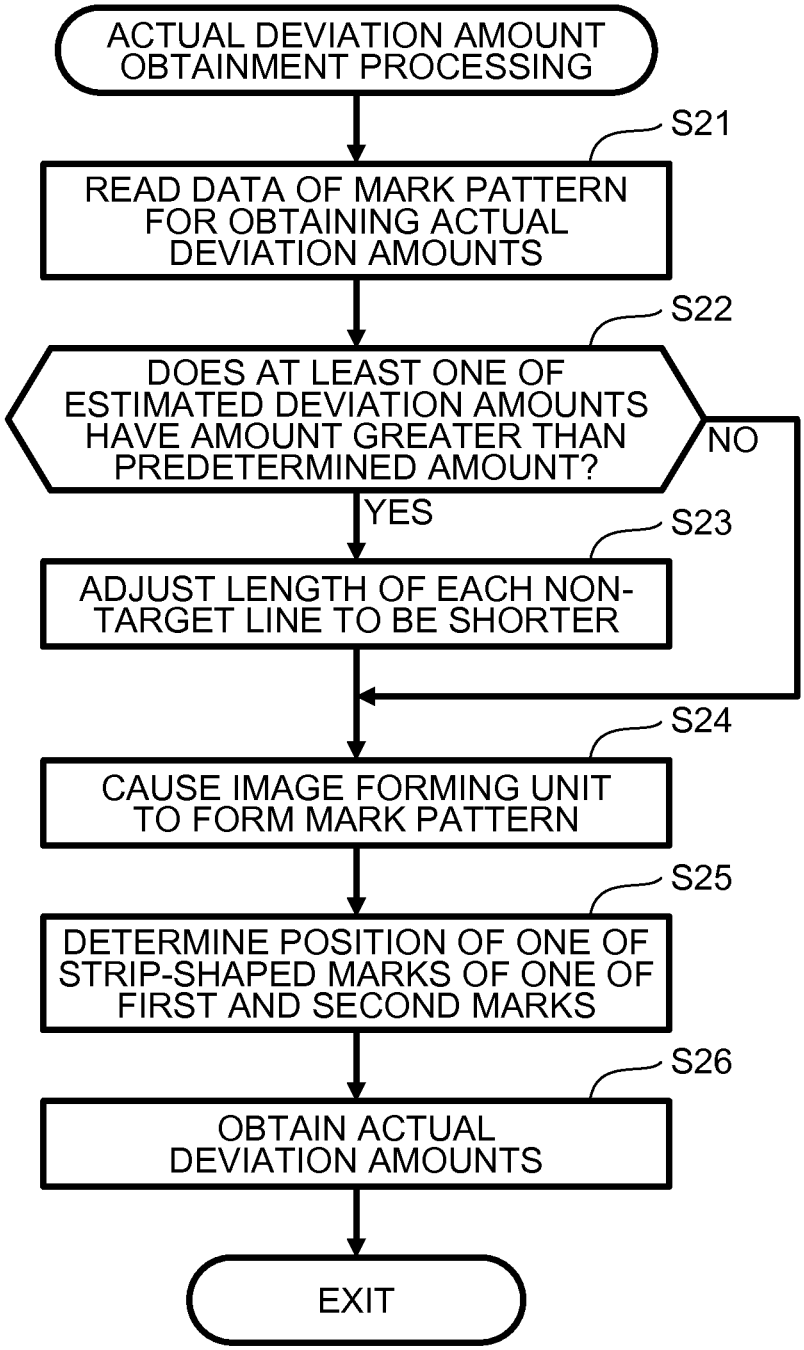
FIG. 7 is a flowchart depicting actual deviation amount obtainment processing in the illustrative embodiment according to one or more aspects of the disclosure.

As depicted in FIG. 7, the CPU 51 reads data of the mark pattern 70 from the nonvolatile memory 54 (e.g., step S21). The mark pattern 70 includes a plurality of mark pairs, for example, first mark 71 and second mark 72 may correspond to a first black mark 71K and a second black mark 72K, respectively, of a black mark pair, a first yellow mark 71Y and a second yellow mark 72Y, respectively, of a yellow mark pair, a first magenta mark 71M and a second magenta mark 72M, respectively, of a magenta mark pair, and a first cyan mark 71C and a second cyan mark 72C, respectively, of a cyan mark pair, which are aligned in this order in the sub-scanning direction. Each of the first and second marks 71 and 72 is an example of a mark. Each of the first and second marks 71 and 72 of each mark pair includes a pair of strip-shaped marks, e.g., a first strip-shaped mark and a second strip-shaped mark. At least one of the first and second strip-shaped marks is angled by a predetermined amount with respect to the main-scanning direction. In the illustrative embodiment, as depicted in FIG. 9, each of the first and second marks 71 and 72 includes a pair of strip-shaped marks including a first strip-shaped mark and a second strip-shaped mark that are both angled by the same degree/angle with respect to the main-scanning direction.

As depicted in FIG. 9, in each mark pair, a first mark 71 is used for obtaining a position of an electrostatic latent image formed by a light beam L1 emitted from the first light source 32. In each strip-shaped mark of the first mark 71, at least endmost toner lines in the sub-scanning direction may be first toner lines LD1. More specifically, each of the first and second strip-shaped marks of the first mark 71 has a plurality of first toner lines LD1 and a second toner line LD2. The first toner lines LD1 are formed at regular intervals in the sub-scanning direction and each of the second toner lines LD2 is formed between corresponding adjacent two of the plurality of first toner lines LD1.

As described above, the first mark 71 includes the second toner lines LD2, each of which is formed between corresponding adjacent two of the plurality of first toner lines LD1 while no gap is provided between adjacent toner lines LD1 and LD2. Therefore, a level change in a detection signal outputted from the mark sensor 6 according to the presence or absence of a first mark 71 on the belt 23 may be greater than a level change in a detection signal outputted from the mark sensor 6 according to the presence or absence of a first mark including no second toner line LD2 formed between each first toner line LD1. Therefore, using such a first mark 71 may prevent or minimize a decrease in accuracy of adjusting an interval between electrostatic latent images formed by respective light beams emitted from the respective different light sources that may be caused by a small level change in detection signal.

In each strip-shaped mark of the first mark 71, each second toner line LD2 is disposed within an overlapping area of corresponding adjacent two of the plurality of first toner lines LD1 (e.g., a first toner line LD1 immediately in front of a second toner line LD2 and a first toner line LD1 immediately behind the second toner line LD2 in the conveying direction) of the plurality of first toner lines LD1. More specifically, one end of the second toner line LD2 in the main-scanning direction does not protrude relative to one ends of the adjacent two first toner lines LD1 on the same side in the main-scanning direction and the other end of the second toner line LD2 in the main-scanning direction does not protrude relative to the other ends of the adjacent two first toner lines LD1 on the same side in the main-scanning direction. In contrast to this, when both ends of the second toner line LD2 in the main-scanning direction protrude relative to both ends of the adjacent to first toner lines LD1 in the main-scanning direction, accuracy of obtaining a position of an electrostatic latent image formed by a light beam L1 may be decreased. As compared with this case, using such a first mark 71 may minimize or prevent the decrease in accuracy of obtaining a position of an electrostatic latent image formed by a light beam L1 caused by the positions of the second toner lines LD2, thereby minimizing or preventing a decrease in accuracy of adjusting an interval between electrostatic latent images formed by respective light beams emitted from the respective different light sources.

In each strip-shaped mark of the first mark 71, all of the first toner lines LD1 have the same length in the main-scanning direction and the first toner lines LD1 are shifted relative to each other by a predetermined amount Z2 in the main-scanning direction. The amount of deviation Z2 may be smaller than an amount of deviation Z1 between adjacent toner lines LD1 relative to each other in the mark 61 of the mark pattern 60 for obtaining actual misregistration amounts (refer to FIG. 8). Therefore, using such a first mark 71 may minimize or prevent a decrease in resolution for obtaining actual deviation amounts as compared with a case where the amount of deviation Z2 between adjacent first toner lines LD1 relative to each other in the first mark 71 is the same as the amount of deviation Z1 between adjacent toner lines LD1 relative to each other in the mark 61.

In each mark pair, a second mark 72 is used for detecting a position of an electrostatic latent image formed by a light beam L2 emitted from the second light source 33. In each of the first and second strip-shaped marks of the second mark 72, at least endmost toner lines in the sub-scanning direction may be second toner lines LD2. More specifically, each of the first and second strip-shaped marks of the second mark 72 has a plurality of second toner lines LD2 and a plurality of first toner lines LD1. The plurality of second toner lines LD2 are formed at regular intervals in the sub-scanning direction and each of the first toner lines LD1 is formed between corresponding adjacent two of the plurality of second toner lines LD2.

In short, the second mark 72 is formed with a reverse toner line arrangement in which the positions of the first toner lines LD1 and the positions of the second toner lines DL2 are opposite to the positions of the first toner lines LD1 and the positions of the second toner lines DL2 of the toner line arrangement in the first mark 71. Nevertheless, the first mark 71 and the second mark 72 have the same features other than the toner line arrangement, and therefore, the detailed description for the second mark 72 will be omitted. Hereinafter, of the first toner lines LD1 and the second toner lines LD2 in each of the first and second marks 71 and 72 of each mark pair, a toner line that is formed using one of the paired light sources 31 and 32 that forms endmost toner lines LD1 or LD2 in the sub-scanning direction is an example of a target line, and a toner line that is formed using the other of the light sources 31 and 32 that is different from the one of the paired light sources 31 and 32 that forms the endmost toner lines LD1 or LD2 in the sub-scanning direction is an example of a non-target line.

If a large relative positional deviation has occurred in a particular paired light sources 32 and 33, and in actually-formed first and second marks 71 and 72 of a particular mark pair corresponding to the particular paired light sources 32 and 33, at least one end of each non-target line in the main-scanning direction protrudes relative to the ends of the adjacent two target lines in the main-scanning direction. That is, a portion of each non-target line protrudes relative to the adjacent two target lines in the sub-scanning direction. Thus, after the CPU 51 reads data of the mark pattern 70 from the nonvolatile memory 54, the CPU 51 adjusts the length of non-target lines of each first and second mark 71, 72 in the particular mark pair included in the read mark pattern 70 to be shorter as the CPU 51 determines that at least one of the estimated deviation amounts has an amount greater than a predetermined amount (e.g., steps S22 and S23), and then the routine proceeds to step S24.

More specifically, the CPU 51 determines whether at least one of the estimated deviation amounts is greater than the predetermined amount (e.g., step S22). When the CPU 51 determines that at least one of the estimated deviation amounts is greater than the predetermined amount (e.g., YES in step S22), the CPU 51 adjusts the length of the non-target lines of each first and second mark 71, 72 in appropriate one or more of the mark pairs such that both ends of each non-target line in the main-scanning direction are within the both respective ends of the adjacent two target lines in the main-scanning direction (e.g., step S23). That is, the length of each second toner line LD2 is shortened in the first mark 71 and the length of each first toner line LD1 is shortened in the second mark 72. Therefore, such an adjustment may minimize or prevent a decrease in accuracy of adjusting an interval between electrostatic latent images formed by respective light beams emitted from the respective different light sources caused by the relative positional deviation in the main-scanning direction.

When the CPU 51 determines that all of the estimated deviation amounts are smaller than or equal to the predetermined amount (e.g., NO in step S22), the routine skips step S23 and proceeds to step S24. In step S24, the CPU 51 causes the drive unit 4A to rotate the conveying mechanism 4 and the photosensitive drums 42 while causing the image forming unit 3 to form the mark pattern 70 on each of the right and left end portions of the belt 23. In step S24, the conveying speed of the conveying mechanism 4 and the rotating speed of the photosensitive drums 42 may be faster than half of the conveying speed and half of the rotating speed at the time of performing printing onto a sheet W (e.g., step S7 of FIG. 3) or at the time of forming a mark pattern 60 on each of the right and left end portions of the belt 23 (e.g., step S12 of FIG. 6). In the illustrative embodiment, hereinafter by way of example, the conveying speed of the conveying mechanism 4 and the rotating speed of the photosensitive drums 42 may be the same as the conveying speed and the rotating speed at the time of performing printing onto a sheet W or at the time of forming the mark patterns 60. Therefore, such a control may enable high-speed formation of first and second marks 71 and 72 as compared with a known configuration in which marks each having scan lines that are formed by a light beam emitted from one of the light sources and are arranged adjacent to each other with no gap therebetween in the sub-scanning direction are formed while the photosensitive body rotates at a speed that is half of the rotating speed of photosensitive body at the time of performing printing onto a sheet.

In some examples, the image forming unit 3 forms a mark pattern 70 on each end portion of the belt 23 in the right-left direction, e.g., onto each particular portion of the end portions that pass the respective detection areas E where the sensors 6R and 6L irradiate with light, in the same manner of forming mark patterns 60 on the belt 23. For instance, the CPU 51 causes the exposure unit 30 to form scan lines LS1 and LS2 to form electrostatic latent images for a mark pair including a first mark 71 and a second mark 72 on the surface of each rotating photosensitive drum 42K, 42Y, 42M, 42C by emitting a light beam L1 and a light beam L2 from a corresponding pair of the first light source 32 and the second light source 33, respectively.

In some arrangements, as depicted in FIG. 2, in the exposure unit 30, the polygon mirror 34 deflects a light beam L1 and a light beam L2 emitted from one of the light source pairs, each including the first light source 32 and the second light source 33, using the same one of the reflecting surfaces 34A thereof simultaneously to form two scan lines LS1 and LS2 on the surface of a corresponding one of the photosensitive drums 42 at the same time. At one of the first scanning and the last scanning, one of the first light source 32 and the second light source 33 in each light source pair is turned off so as not to emit a light beam. With this control, each of the first and second marks 71 and 72 has an odd number of toner lines. Thus, this control may enable high-speed formation of first and second marks 71 and 72 as compared with a case where a light beam emitted from one of the paired light sources and a light beam emitted from the other of the paired light sources are reflected off respective different reflecting surfaces 34A of the polygon mirror 34.

Upon starting formation of the mark pattern 70 on each of the right and left end portions of the belt 23, the CPU 51 obtains an actual deviation amount of the first and second marks 71 and 72 in each mark pair based on the level of a detection signal that is outputted, from the mark sensor 6, corresponding to both end most toner lines of each of the first and second marks 71 and 72 in each mark pair in the sub-scanning direction (e.g., steps S25 and S26). For example, as depicted in FIG. 9, the level of the detection signal outputted from the mark sensor 6 falls below a second threshold TH2 after one of endmost toner lines of one of first and second strip-shaped marks of one of the first and second marks 71 and 72 in the sub-scanning direction passes a corresponding detection area E. Further, the level of the detection signal outputted from the mark sensor 6 matches the second threshold TH2 when the other of the endmost toner lines of the one of the first and second strip-shaped marks of the one of the first and second marks 71 and 72 in the sub-scanning direction passes the corresponding detection area E. The CPU 51 determines a position XC2 as a position of the one of the first and second strip-shaped marks in the one of the first and second marks 71 and 72 in a particular mark pair (e.g., step S25). The position XC2 may be a middle position between a position XD2 and a position XU2. The position XD2 corresponds to a timing at which the level of the detection signal outputted from the mark sensor 6 reaches the second threshold TH2 while decreasing. The position XU2 corresponds to a timing at which the level of the detection signal outputted from the mark sensor 6 reaches the second threshold TH2 while rising.

The first and second marks 71 and 72 has non-target lines that are shorter in length than target lines. Therefore, the change in the level of the detection signal outputted from the mark sensor 6 when the mark sensor 6 detects the first and second marks 71 and 72 is smaller than the change in the level of the detection signal outputted from the mark sensor 6 when the mark sensor 6 detects the marks 61 of the mark patterns 60 for obtaining actual misregistration amounts. Thus, the second threshold TH2 is closer to the level of the detection signal outputted from the mark sensor 6 when no mark is present within the detection area E, than the first threshold TH1. Therefore, the CPU 51 may detect the positions of the first and second marks 71 and 72 with precision as compared with a case where the second threshold TH2 is set to the same level as the first threshold TH1, thereby precisely adjusting an interval between electrostatic latent images formed by respective light beams emitted from the respective different light sources.

The CPU 51 determines a position XZ2 as a position of a mark 71, 72 in the sub-scanning direction for each color. The position XZ2 may be a middle position between the position XC2 of one of the first and second strip-shaped marks in the mark 71, 72 and the position XC2 of the other of the first and second strip-shaped marks in the mark 71, 72. The CPU 51 further obtains an interval D3 between the first mark 71 and the second mark 72 in each mark pair in the sub-scanning direction based on the obtained positions XZ2 of the first and second marks 71 and 72 in the sub-scanning direction. The position of each of the first and second marks 71 and 72 and the interval D3 between the first and second marks 71 and 72 in a mark pair 70PA are determined on a color basis. The interval D3 may vary in accordance with an actual deviation amount in the sub-scanning direction. The CPU 51 obtains an actual deviation amount in the sub-scanning direction on a color basis (e.g., step S26) and stores the obtained actual deviation amounts in the nonvolatile memory 54.

The CPU 51 obtains an interval D4 between the position XC2 of the one of the first and second strip-shaped marks and the position XC2 of the other of the first and second strip-shaped marks in each of the first and second marks 71 and 72. Then, the CPU 51 obtains a difference in interval D4 between the first mark 71 and the second mark 72 in each mark pair 70PA. The amount of the difference in interval D4 between the first mark 71 and the second mark 72 in a mark pair may vary in accordance with the actual deviation amount in the main-scanning direction. The CPU 51 obtains an actual deviation amount in the main-scanning direction on a color basis (e.g., step S26) and stores the obtained actual deviation amounts in the nonvolatile memory 54.

Upon obtainment of the actual deviation amounts, the routine proceeds to step S7 of FIG. 5 and the CPU 51 causes the image forming unit 3 to perform printing onto a sheet W based on image data in response to a print instruction while adjusting the respective timing of starting exposure for each color so as to compensate the actual deviation amounts in the main-scanning direction. The obtained actual deviation amounts in the sub-scanning direction may be used, for example, for adjusting the transfer positions for images with respect to a sheet W.

In step S5, when the CPU 51 determines that the condition for executing obtainment of actual deviation amounts is not satisfied (e.g., NO in step S5), the routine skips steps S3 and S6 and proceeds to step S7.

According to the illustrative embodiment, electrostatic latent images for a mark pair, including a first mark 71 and a second mark 72, is formed corresponding to one of the light source pairs, each of the light source pairs including the first light source 32 and the second light source 33. Each of the first and second marks 71 and 72 includes a plurality of scan lines that are formed by a light beam emitted from the same one of the paired light sources 32 and 33 with a gap provided between the scan lines in the sub-scanning direction. Additionally, at least both endmost scan lines of each of the marks 71 and 72 in the sub-scanning direction are formed by a light beam emitted from the same one of the paired light sources 32 and 33. Then, the interval between electrostatic latent images formed by respective light beams emitted from the respective different light sources is adjusted using each mark pair including the first mark 71 and the second mark 72 formed as described above. The above-described configuration may enable the adjustment of the interval between electrostatic latent images formed by respective light beams emitted from the respective different light sources.

Figure 10:
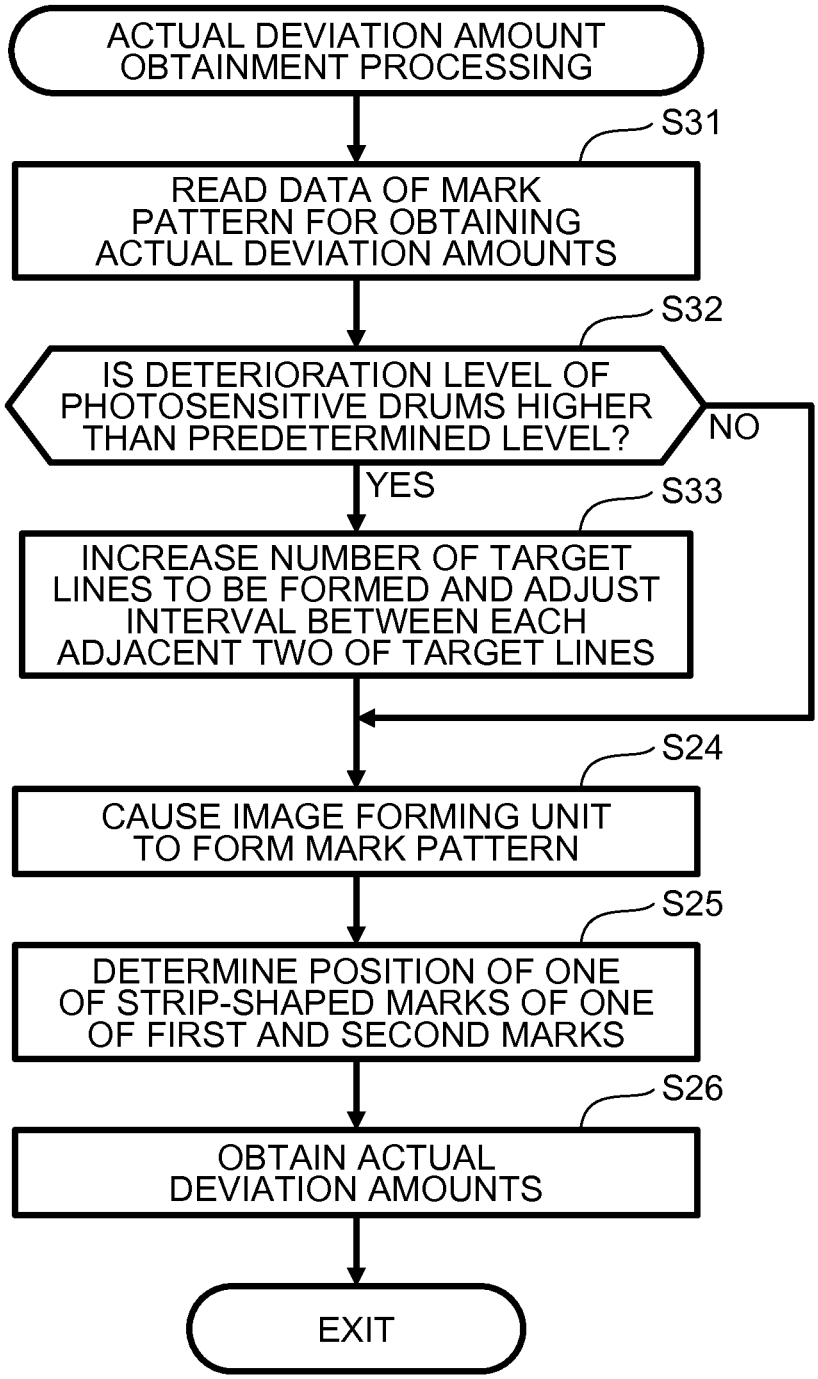
FIG. 10 is a flowchart depicting actual deviation amount obtainment processing in another illustrative embodiment according to one or more aspects of the disclosure.
Figure 11:
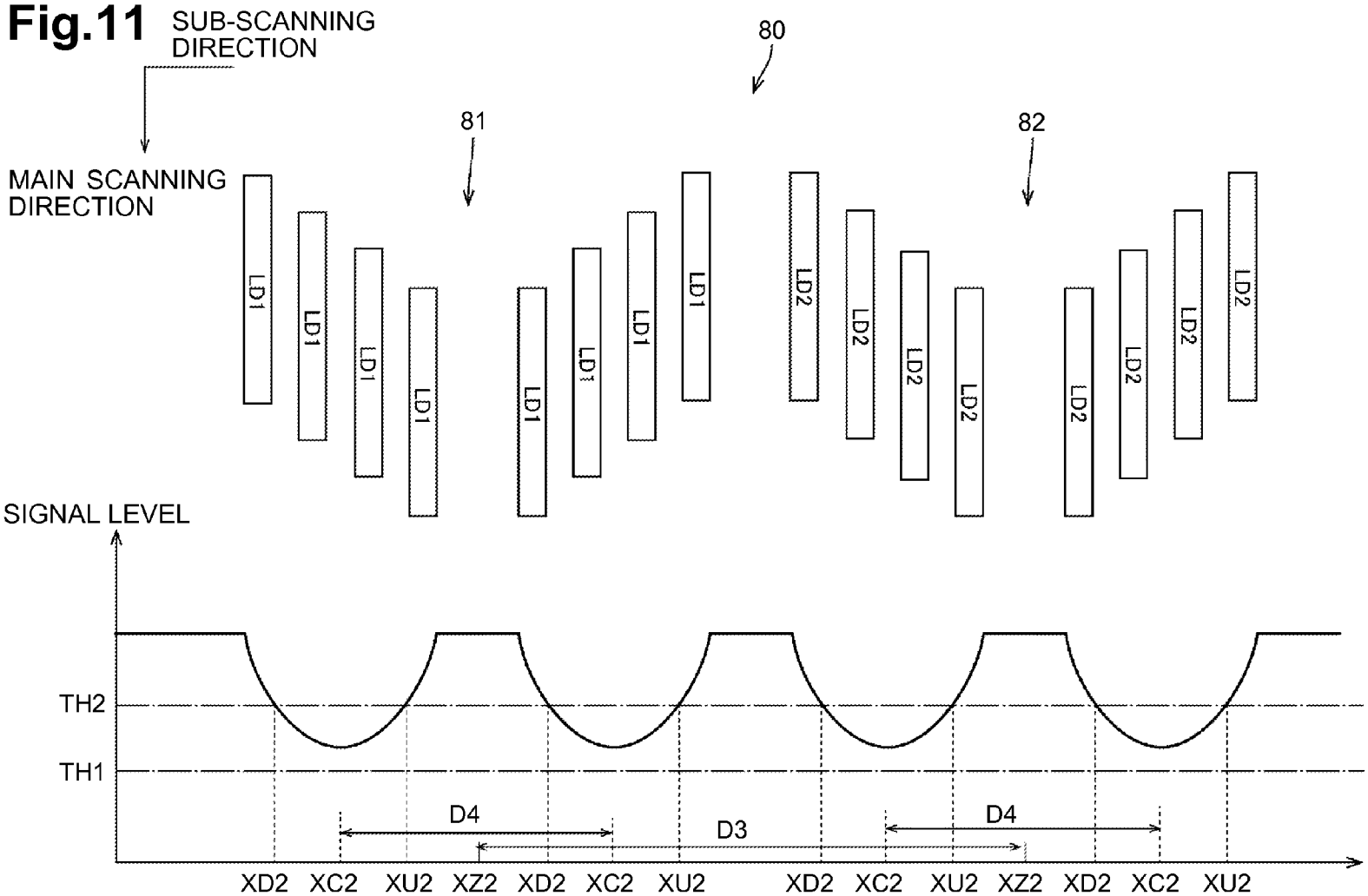
FIG. 11 is a diagram depicting a relationship between a mark pattern for obtaining actual deviation amounts and a change in a detection signal level in the other illustrative embodiment according to one or more aspects of the disclosure.

Referring to FIGS. 10 and 11, another illustrative embodiment will be described. Actual deviation amount obtainment processing according to this illustrative embodiment is different from the actual deviation amount obtainment processing according to the above-described embodiment. The other features according to this illustrative embodiments are the same as or similar to the features according to the above-described illustrative embodiment. Therefore, common parts have the same reference numerals as those of the above-described illustrative embodiment, and the detailed description of the common parts is omitted.

According to this illustrative embodiment, in step S5 of FIG. 5, when the CPU 51 determines that the condition for executing obtainment of actual deviation amounts is satisfied (e.g., YES in step S5), the CPU 51 executes the actual deviation amount obtainment processing of FIG. 10 (e.g., step S6). The CPU 51 reads data of a mark pattern 80 for obtaining actual deviation amounts from the nonvolatile memory 54 (e.g., step S31). The mark pattern 80 includes a plurality of mark pairs, for example, first mark 81 and second mark 82 may correspond to a first black mark 81K and a second black mark 82K, respectively, of a black mark pair, including a first yellow mark 81Y and a second yellow mark 82Y, respectively, of a yellow mark pair, a first magenta mark 81M and a second magenta mark 82M, respectively, of a magenta mark pair, and a first cyan mark 81C, and a second cyan mark 82C, respectively, of a cyan mark pair, which are aligned in this order in the sub-scanning direction. Each of the first and second marks 81 and 82 is an example of a mark. Each of the first and second marks 81 and 82 of each mark pair include a pair of strip-shaped marks, e.g., a first strip-shaped mark and a second strip-shaped mark. At least one of the first and second strip-shaped marks is tilted or angled by a predetermined degree/angle with respect to the main-scanning direction. In this illustrative embodiment, as depicted in FIG. 11, each of the first and second marks 81 and 82 includes a pair of strip-shaped marks including a first strip-shaped mark and a second strip-shaped mark that are both tilted/angled by the same amount/angle with respect to the main-scanning direction.

As depicted in FIG. 11, in each mark pair, a first mark 81 is used for obtaining a position of an electrostatic latent image formed by a light beam L1 emitted from the first light source 32. Each of the first and second strip-shaped marks of the first mark 81 includes first toner lines LD1 only. More specifically, in each strip-shaped mark of the first mark 81, a plurality of first toner lines LD1 are formed at regular intervals in the sub-scanning direction while no second toner line LD2 is formed between each adjacent two of the plurality of first toner lines LD1. Forming such a first mark 81 may reduce a load of forming marks and toner consumption as compared with forming the first and second marks 71 and 72 each having both first and second toner lines LD1 and LD2 according to the previously-described illustrative embodiment.

In each strip-shaped mark of the first mark 81, all of the first toner lines LD1 have the same length in the main-scanning direction and the first toner lines LD1 are shifted relative to each other by a predetermined amount in the main-scanning direction. The amount of deviation between adjacent first toner lines LD1 relative to each other in the first mark 81 may be smaller than an amount of deviation Z1 between adjacent toner lines LD1 relative to each other in the mark 61 of the mark pattern 60 for obtaining actual misregistration amounts. Therefore, using such a first mark 81 may restrict a decrease in resolution for obtaining actual deviation amounts as compared with a case where the amount of deviation between adjacent toner lines LD1 relative to each other in the first mark 81 is the same as the amount of deviation Z1 between adjacent toner lines LD1 relative to each other in the mark 61.

In each mark pair, a second mark 82 is used for obtaining a position of an electrostatic latent image formed by a light beam L2 emitted from the second light source 33. Each of the first and second strip-shaped marks of the second mark 82 includes second toner lines LD2 only. For example, in each strip-shaped mark of the second mark 82, a plurality of second toner lines LD2 are formed at regular intervals (e.g., the same interval) in the sub-scanning direction while no first toner line LD1 is formed between each adjacent two of the plurality of second toner lines LD2. In short, the second mark 82 has the plurality of second toner lines LD2 only while the first mark 82 has the plurality of first toner lines LD1 only. Nevertheless, the first mark 81 and the second mark 82 have the same features other than the type of toner lines, and therefore, the detailed description for the second mark 82 will be omitted.

As the deterioration level of the photosensitive drums 42 increases, an amount of toner adhering to the surface of the photosensitive drums 42 decreases. As a result, the change in the level of the detection signal outputted from the mark sensor 6 may become small. Thus, after the CPU 51 reads data of the mark pattern 80 from the nonvolatile memory 54, the CPU 51 increases the number of target lines to be formed in each of the first and second marks 81 and 82 of the mark pattern 80 and adjusts (e.g. narrows) the interval between each adjacent two of the target lines as the deterioration level of the photosensitive drums 42 is higher (e.g., steps S32 and S33), and then the routine proceeds to step S24.

In one arrangement, the CPU 51 obtains the deterioration level of the photosensitive drums 42. The CPU 51 obtains the deterioration level based on, for example, the number of rotations of the photosensitive drums 42 or the number of sheets printed since the photosensitive drums 42 were first used. The CPU 51 determines whether the deterioration level of the photosensitive drums 42 is higher than a predetermined level (e.g., step S32). When the CPU 51 determines that the deterioration level of the photosensitive drums 42 is higher than the predetermined level (e.g., YES in step S32), the CPU 51 increases the number of target lines to be formed in each of the first and second marks 81 and 82 of each mark pair in the mark pattern 80 and adjusts (e.g. narrows) the interval between each adjacent two of the target lines (e.g., step S33).

For example, the CPU 51 controls the rotating speed of the photosensitive drums 42 and the conveying speed of the conveying mechanism 4 at the time of forming first and second marks 81 and 82 on the belt 23 so that both of the rotating speed and the conveying speed become slower than the rotating speed and the conveying speed at the time of printing a sheet W. With this control, the CPU 51 may increase the number of target lines to be formed and narrow the gap between each adjacent two of the target lines in the sub-scanning direction. Therefore, this control may restrict (e.g., minimize or prevent) the change in the level of detection signals outputted from the mark sensor 6 according to the presence or absence of one of marks 81 and 82 on the belt 23, from becoming small. Thus, this control may further restrict a decrease in accuracy of adjusting an interval between electrostatic latent images formed by respective light beams emitted from the respective different light sources caused by the deterioration of the photosensitive drums 42.

When the CPU 51 determines that the deterioration level of the photosensitive drums 42 is less than or equal to the predetermined level (e.g., NO in step S32), the routine skips step S33 and proceeds to step S24. In other embodiments, for example, the CPU 51 may determine a deterioration level of the belt 23 instead of the photosensitive drums 42.

While the disclosure has been described in detail with reference to example embodiments thereof, it is not limited to such examples. Various changes, arrangements and modifications may be applied to the detailed configuration without departing from the spirit and scope of the disclosure.

The image forming apparatus is not limited to a color laser printer of a tandem direct transfer type. In other embodiments, for example, the image forming apparatus may be an image forming apparatus of other type, for example, an image forming apparatus of intermediate transfer type or an image forming apparatus of a 4-cycle electrophotographic type. The image forming apparatus may be a monochrome image forming apparatus instead of the color image forming apparatus. The image forming apparatus may be, for example, a printer, a copying machine, a facsimile machine, or a multifunctional device.

In other embodiments, the multi-beam scanning unit may include three or more light sources as a set for each color and may be configured to form three or more scan lines on a surface of a single photosensitive body simultaneously using light beams emitted from the respective different three or more light sources. In the above-described illustrative embodiments, the exposure unit 30 includes a single polygon mirror 34 for all four colors. Nevertheless, in other embodiments, for example, the exposure unit 30 may include a plurality, for example, four, of polygon mirrors 34 for respective colors.

The sensor is not limited to the mark sensor 6. In other embodiments, for example, the sensor may be a sensor configured to output detection signals according to one of an electrostatic latent image for a mark and a toner image formed on the surface of each of the photosensitive drums 42.

In other embodiments, for example, in step S13 of FIG. 6 and step S25 of FIGS. 7 and 10, the CPU 51 may detect marks 61, 71, 72, 81, and 82 using, for example, a hysteresis comparator based on results of comparison between two thresholds and the signal level.

In the above-described illustrative embodiments, the controller includes a single CPU (e.g., the CPU 51) and the single CPU executes the processing of FIGS. 5, 6, 7, and 10. Nevertheless, in other embodiments, for example, the controller may include a plurality CPUs, hardware (e.g., the ASIC 55), or a combination thereof (e.g., a combination of a CPU and an ASIC) for executing the processing of FIGS. 5, 6, 7, and 10.

In the above-described illustrative embodiments, the estimated misregistration amount is used for the determination of satisfaction of the condition for executing obtainment of actual misregistration amounts and the estimated deviation amount is used for the determination of satisfaction of the condition for executing obtainment of actual deviation amounts. Nevertheless, in other embodiments, for example, the satisfaction of the condition for executing obtainment of actual misregistration amounts or the satisfaction of the condition for executing obtainment of actual deviation amounts may be determined in response to one of attainment of printing of a predetermined number of sheets W since one of the last actual misregistration amount obtainment processing and the last actual deviation amount obtainment processing was performed, an amount of time elapsing since the printer 1 was turned on, and receipt of an instruction to execute one of the obtainment of actual misregistration amounts and the obtainment of actual deviation amounts by the accepting unit 57.

Each of the marks 61, 71, 72, 81, and 82 may include a pair of strip-shaped marks extending in the sub-scanning direction.

In the first mark 71 and the second mark 72, at least one of the ends of a non-target line in the main-scanning direction may protrude relative to the ends of adjacent two of the plurality of target lines in the main-scanning direction.

The amount of deviation between adjacent two target lines relative to each other in the marks 71, 72, 81, and 82 in the main scanning direction may be greater than the amount of deviation between adjacent two target lines relative to each other in the mark 61 in the main scanning direction.

For example, the gap between each adjacent two of the target lines in the sub-scanning direction may be changed by controlling a timing of forming a target line relative to the rotation of the polygon mirror 34. In step S33, the gap between each adjacent two of the target lines may be changed by changing a target line formation manner in which one target line is formed every several rotations of the polygon mirror 34 to another manner in which one target line is formed every one rotation of the polygon mirror 34.

Color characteristics may be different between achromatic toner and chromatic toner. This color characteristic difference may cause a difference in change in the level of the detection signal outputted from the mark sensor 6 according to the presence or absence of a mark on the belt 23 between achromatic toner and chromatic toner. Therefore, in other embodiments, for example, marks 71, 72, 81, and 82 to be developed using chromatic toner may have more target lines with narrower gaps therebetween than marks 71, 72, 81, and 82 to be developed using achromatic toner. This control may minimize/prevent a decrease in accuracy of adjusting an interval between electrostatic latent images by respective light beams emitted from the respective different light sources caused by color characteristic difference of toner.

According to the aspects of the disclosure, the interval between electrostatic latent images formed by respective light beams emitted from respective different light sources may be adjusted using the configuration different from the known configuration.

What is claimed is:

1. An image forming apparatus comprising:

a photosensitive body;

a drive unit configured to drive the photosensitive body to rotate;

a forming unit including:

a developing unit; and a first light source for the developing unit and a second light source for the developing unit;

a sensor; and a controller configured to:

cause the first light source and the second light source to form marks on a surface of the photosensitive body being rotated by the drive unit, wherein each of the marks has a plurality of scan lines that are formed by light emitted from at least one of the first and second light sources, wherein the marks include a first mark and a second mark prior to or subsequent to the first mark in a sub-scanning direction, wherein endmost scan lines of the plurality of scan lines in the sub-scanning direction in the first mark are formed by light emitted from the first light source, wherein endmost scan lines of the plurality of scan lines in the sub-scanning direction in the second mark are formed by light emitted from the second light source which is different from the first light source; and adjust at least one of a position of an electrostatic latent image to be formed on the surface of the photosensitive body by the first light source and a position of another electrostatic latent image to be formed on the surface of the photosensitive body by the second light source based on a level of a signal from the sensor for the endmost scan lines of the first mark and a level of a signal from the sensor for the endmost scan lines of the second mark, wherein the plurality of scan lines of each of the marks includes first lines and second lines, wherein all of the first lines are formed by light emitted from the first light source and all of the second lines are formed by light emitted from the second light source, and wherein each of the second lines are formed between corresponding adjacent two lines of the first lines.

2. The image forming apparatus according to claim 1, further comprising an N number of light sources, the N number of light sources including the first light source and the second light source, wherein the controller is further configured to cause the N number of light sources to form, on the surface of the photosensitive body being rotated by the drive unit, an electrostatic latent image for an image to be transferred onto a sheet, and wherein, when the marks are formed on the surface of the photosensitive body, the drive unit rotates the photosensitive body at a rotating speed that is faster than 1/N of a rotating speed of the photosensitive body when forming the electrostatic latent image on the surface of the photosensitive body.

3. The image forming apparatus according to claim 1, wherein the first light source and the second light source are comprised within a multi-beam scanning unit, the multi-beam scanning unit further comprising a rotatable polygon mirror that has a plurality of reflecting surfaces, wherein the first light source and the second light source are configured to irradiate the surface of the photosensitive body with light emitted from the first light source and the second light source by deflecting the light off of one or more of the plurality of reflecting surfaces of the polygon mirror, and wherein the controller is further configured to cause the polygon mirror to deflect light emitted from the first light source and light emitted from the second light source using a same reflecting surface of the plurality of reflecting surfaces.

4. The image forming apparatus according to claim 1, wherein, in each of the marks, the first lines are shifted relative to each other in a main-scanning direction, and wherein each of the second lines is disposed within an overlapping area of corresponding adjacent two lines of the first lines in the main-scanning direction.

5. The image forming apparatus according to claim 1, wherein the controller is further configured to:

estimate an amount of relative positional deviation between electrostatic latent images based on an amount of change in one or more factors that cause the relative positional deviation; and form, when forming the marks on the surface of the photosensitive body, the second lines having a shorter length as the estimated amount of relative positional deviation becomes larger.

6. The image forming apparatus according to claim 1, further comprising a plurality of photosensitive bodies including the photosensitive body, wherein the forming unit includes a plurality of developing units including the developing unit, wherein an N number of light sources including the first light source and the second light source are provided for each of the plurality of developing units, wherein the controller is configured to:

cause the N number of light sources to form a mark used for obtaining a misregistration amount on a surface of each of the plurality of photosensitive bodies being rotated by the drive unit by N number of light beams emitted from the N number of light sources, respectively, provided for each of the plurality of developing units;

adjust transfer positions of images developed by the plurality of developing units, relative to each other, with respect to a sheet, based on a result of a comparison between a first threshold and the level of the signal outputted from the sensor according to the mark used for obtaining the misregistration amount with respect to the plurality of photosensitive bodies; and adjust at least one of positions of electrostatic latent images based on a result of a comparison between a second threshold and the level of the signal from the sensor for the endmost scan lines of each of the marks, and wherein the second threshold is closer to the level of the signal from the sensor while the surface of the photosensitive body is not exposed than the first threshold.

7. The image forming apparatus according to claim 1, further comprising an image carrier, wherein the controller is further configured to:

determine a deterioration level of the image carrier; and when forming the marks on the surface of the photosensitive body, increase a number of scan lines to be formed by a same light source of the first and second light sources and narrow a gap between each adjacent two scan lines of the plurality of scan lines to be formed by the same light source of the first and second light sources as the deterioration level of the image carrier increases.

8. The image forming apparatus according to claim 1, further comprising a plurality of photosensitive bodies including the photosensitive body, wherein the forming unit includes a chromatic developing unit storing chromatic toner therein and an achromatic developing unit storing achromatic toner therein, wherein an N number of light sources including the first light source and the second light source are provided for each of the plurality of developing units, and wherein the controller is further configured to:

cause the N number of light sources to form the marks on a surface of the photosensitive body for the chromatic developing unit and a surface of the photosensitive body for the achromatic developing unit so that the marks to be developed by the chromatic developing unit have more scan lines to be formed by a same light source of the N number of light sources for the chromatic developing unit than the marks to be developed by the achromatic developing unit, and have a narrower gap between each adjacent two scan lines of the plurality of scan lines to be formed by the same light source of the N number of light sources for the chromatic developing unit than the marks to be developed by the achromatic developing unit; and adjust at least one of positions of electrostatic latent images to be formed on the surface of the photosensitive body for the chromatic developing unit based on the level of the signal from the sensor for the endmost scan lines of each of the marks developed using the achromatic toner and at least one of positions of electrostatic latent images formed on the surface of the photosensitive body for the achromatic developing unit based on the level of the signal from the sensor for the endmost scan lines of each of the marks developed using the achromatic toner.

9. An image forming apparatus comprising:

a photosensitive body;

a drive unit configured to drive the photosensitive body to rotate;

a forming unit including:

a developing unit; and

N number of light sources including a first light source for the developing unit and a second light source for the developing unit;

a sensor; and a controller configured to:

cause the first light source and the second light source to form marks on a surface of the photosensitive body being rotated by the drive unit, wherein each of the marks has a plurality of scan lines that are formed by light emitted from at least one of the first and second light sources, wherein the marks include a first mark and a second mark prior to or subsequent to the first mark in a sub-scanning direction, wherein endmost scan lines of the plurality of scan lines in the sub-scanning direction in the first mark are formed by light emitted from the first light source, wherein endmost scan lines of the plurality of scan lines in the sub-scanning direction in the second mark are formed by light emitted from the second light source which is different from the first light source;

adjust at least one of a position of an electrostatic latent image to be formed on the surface of the photosensitive body by the first light source and a position of another electrostatic latent image to be formed on the surface of the photosensitive body by the second light source based on a level of a signal from the sensor for the endmost scan lines of the first mark and a level of a signal from the sensor for the endmost scan lines of the second mark; and cause the N number of light sources to form, on the surface of the photosensitive body being rotated by the drive unit, the electrostatic latent image to be transferred onto a sheet, wherein, when the marks are formed on the surface of the photosensitive body, the drive unit rotates the photosensitive body at a rotating speed that is faster than 1/N of a rotating speed of the photosensitive body when forming the electrostatic latent image on the surface of the photosensitive body.

10. An image forming apparatus comprising:

a plurality of photosensitive bodies;

a drive unit configured to drive the photosensitive bodies to rotate;

a forming unit including:

a plurality of developing units; and

N number of light sources for each of the developing units, each N light sources including a respective first light source and a respective second light source;

a sensor; and a controller configured to:

for each of the developing units, cause the corresponding N number of light sources to form marks used to obtain a misregistration amount on a surface of a respective one of the plurality of photosensitive bodies being rotated by the drive unit, the marks being formed by N number of light beams emitted from the corresponding N number of light sources, respectively, wherein forming the marks includes:

causing the respective first light source and the respective second light source to form the marks, wherein each of the marks has a plurality of scan lines that are formed by light emitted from a same light source of the respective first and second light sources, wherein the marks include a first mark and a second mark prior to or subsequent to the first mark in a sub-scanning direction, wherein endmost scan lines of the plurality of scan lines in the sub-scanning direction in the first mark are formed by light emitted from the respective first light source, wherein endmost scan lines of the plurality of scan lines in the sub-scanning direction in the second mark are formed by light emitted from the respective second light source which is different from the respective first light source;

adjust transfer positions of images developed by the plurality of developing units, relative to each other and with respect to a sheet, based on a result of a comparison between a first threshold and a level of a signal from the sensor according to the marks used to obtain the misregistration amount with respect to the plurality of photosensitive bodies; and adjust at least one of positions of electrostatic latent images to be formed on a surface of one of the photosensitive bodies based on a result of a comparison between a second threshold and a level of a signal from the sensor for the endmost scan lines of each of the marks used for obtaining the misregistration amount, wherein the second threshold is closer to the level of the signal from the sensor while the surface of the one of the photosensitive bodies is not exposed than the first threshold, wherein adjusting the at least one of the positions of the electrostatic latent images includes:

adjusting at least one of a position of an electrostatic latent image to be formed on the surface of the one of the photosensitive bodies by a corresponding first light source and a position of another electrostatic latent image to be formed on the surface of the one of the of the photosensitive body by a corresponding second light source based on the level of the signal from the sensor for the endmost scan lines of a corresponding first mark and the level of the signal from the sensor for the endmost scan lines of a corresponding second mark.

* * * * *